US005692550A

United States Patent [19]

Ford et al.

[11] Patent Number: 5,692,550

[45] Date of Patent: *Dec. 2, 1997

[54] CELLULAR SHADE MATERIAL

[75] Inventors: James Arthur Ford; Don Lee Bertva, both of Sturgis, Mich.; James Murrell Kennedy, Elkhart, Ind.; Ronald Lynn Presdorf, Sturgis, Mich.

[73] Assignee: Cooper Industries, Inc., Houston, Tex.

[ * ] Notice: The term of this patent shall not extend beyond the expiration date of Pat. No. Des. 352,856.

[21] Appl. No.: 699,593

[22] Filed: Aug. 19, 1996

Related U.S. Application Data

[63] Continuation of Ser. No. 208,981, Mar. 10, 1994, abandoned.

[51] Int. Cl.[6] ..... E06B 3/94

[52] U.S. Cl. ..... 160/84.05; 156/197; 428/116

[58] Field of Search ..... 160/84.01, 84.05; 156/193, 197; 428/116, 118

[56] References Cited

U.S. PATENT DOCUMENTS

| | | | |
|---|---|---|---|
| Re. 30,254 | 4/1980 | Rasmussen | 160/84 |
| D. 352,856 | 11/1994 | Ford | D6/575 |
| 2,201,356 | 5/1940 | Terrell . | |
| 3,296,059 | 1/1967 | Schwindt | 161/69 |
| 3,646,377 | 2/1972 | Ellis | 98/110 |
| 3,952,733 | 4/1976 | Scholer | 160/84 |
| 3,999,590 | 12/1976 | Koch | 160/84 |
| 4,019,554 | 4/1977 | Rasmussen | 160/84 |
| 4,288,485 | 9/1981 | Suominen | 428/116 |
| 4,307,768 | 12/1981 | Anderson | 160/84 |
| 4,347,887 | 9/1982 | Brown | 160/368 |
| 4,422,492 | 12/1983 | Bledsoe | 160/84 |
| 4,450,027 | 5/1984 | Colson | 156/193 |
| 4,535,828 | 8/1985 | Brockhaus | 160/84 |
| 4,544,011 | 10/1985 | Sawamura | 160/84 |
| 4,603,072 | 7/1986 | Colson | 428/116 |
| 4,603,725 | 8/1986 | Knight | 160/243 |
| 4,625,786 | 12/1986 | Carter et al. | 160/84 |
| 4,631,108 | 12/1986 | Colson | 156/461 |
| 4,631,217 | 12/1986 | Anderson | 428/118 |

(List continued on next page.)

FOREIGN PATENT DOCUMENTS

| | | | |
|---|---|---|---|
| 129793 | 11/1948 | Australia . | |
| 756270 | 9/1956 | United Kingdom . | |
| 2 236 551 | 4/1991 | United Kingdom | E06B 9/262 |
| 2 247 698 | 3/1992 | United Kingdom | D06J 1/06 |

OTHER PUBLICATIONS

Declaration of Dorothy L. Collins.
Declaration of James A. Ford.
Declaration of Dan Krohn.
Declaration of Thomas J. Marusak, dated Apr. 30, 1997.
Declaration of Thomas J. Marusak, dated Jun. 23, 1997.
Declaration of Alan Katz.
Declaration of Barry Markman.
Declaration of Ricky T. Spencer.
Deposition transcript of Barry Markman.
Deposition transcript of Ricky Spencer.
Physical exhibit of rosette.
A/S Chr. Fabers Fabriker, *Faber's Thermally Insulating Venetian Blinds;* 1941 catalog (No. 25) Denmark.
A/S Chr. Fabers Fabriker, *Faber's Thermally Insulating Venetian Blinds;* 1943 catalog (No. 26) Denmark.
A/S Chr. Fabers Fabriker, *Faber's Thermally Insulating Venetian Blinds;* undated catalog (No. 27) Denmark.
Declaration of Mr. Aage Mortensen Feb. 18, 1997.
Declaration of Mr. I. Sogaard Andersen Jan. 17, 1997.

*Primary Examiner*—Blair Johnson
*Attorney, Agent, or Firm*—Kenyon & Kenyon

[57] ABSTRACT

A cellular pleated shade material is provided for cellular pleated shades. Each pleat thereof is formed from a single strip of shade material which is folded longitudinally in half, and the edges thereof are glued together to form a fin. The side of one cell is affixed to the side of the next adjacent cell adjacent the centerline of the sides. The ratio of cell height to cell width may be varied, without affecting the overall aesthetic presentation of the shade, by varying the size of the fin.

47 Claims, 3 Drawing Sheets

U.S. PATENT DOCUMENTS

| | | | |
|---|---|---|---|
| 4,647,488 | 3/1987 | Schnebly et al. | 428/116 |
| 4,673,600 | 6/1987 | Anderson | 428/12 |
| 4,675,060 | 6/1987 | Schnebly et al. | 156/65 |
| 4,676,855 | 6/1987 | Anderson | 156/193 |
| 4,677,012 | 6/1987 | Anderson | 428/116 |
| 4,677,013 | 6/1987 | Anderson | 428/116 |
| 4,685,986 | 8/1987 | Anderson | 156/197 |
| 4,687,039 | 8/1987 | Chumbley | 160/84 |
| 4,694,144 | 9/1987 | Delaroche et al. | 160/84.01 X |
| 4,732,630 | 3/1988 | Schnebly | 156/64 |
| 4,762,161 | 8/1988 | Anderson | 160/178.2 |
| 4,777,673 | 10/1988 | Patteson et al. . | |
| 4,793,396 | 12/1988 | Anderson et al. | 160/84.1 |
| 4,795,515 | 1/1989 | Kao et al. | 156/197 |
| 4,813,468 | 3/1989 | Fraser | 160/84.1 |
| 4,846,243 | 7/1989 | Schneider | 160/84.1 |
| 4,849,039 | 7/1989 | Colson et al. | 156/197 |
| 4,861,404 | 8/1989 | Neff | 156/204 |
| 4,862,941 | 9/1989 | Colson | 160/84.1 |
| 4,871,006 | 10/1989 | Kao et al. | 160/84.1 |
| 4,884,612 | 12/1989 | Schnebly et al. | 160/84.1 |
| 4,885,190 | 12/1989 | Schnebly | 427/207.1 |
| 4,901,419 | 2/1990 | Voss | 29/412 |
| 4,913,210 | 4/1990 | Colson et al. | 160/84.1 |
| 4,915,763 | 4/1990 | Swiszcz | 156/209 |
| 4,928,369 | 5/1990 | Schnebly et al. | 29/24.5 |
| 4,934,434 | 6/1990 | Schnebly et al. | 160/84.1 |
| 4,934,436 | 6/1990 | Schnebly | 160/84.1 |
| 4,943,454 | 7/1990 | Neff | 428/12 |
| 4,945,969 | 8/1990 | Schnebly et al. | 160/84.1 |
| 4,974,856 | 12/1990 | Judkins | 160/84.1 |
| 5,002,112 | 3/1991 | Schnebly et al. | 160/84.1 |
| 5,002,628 | 3/1991 | Schnebly | 156/379 |
| 5,015,317 | 5/1991 | Corey et al. | 160/84.01 X |
| 5,043,038 | 8/1991 | Colson | 156/193 |
| 5,043,039 | 8/1991 | Swiszcz | 156/197 |
| 5,049,424 | 9/1991 | Carden et al. | 428/35.8 |
| 5,078,195 | 1/1992 | Schon | 160/84.1 |
| 5,097,884 | 3/1992 | Sevcik et al. | 160/84.1 |
| 5,106,444 | 4/1992 | Corey et al. | 156/197 |
| 5,129,440 | 7/1992 | Colson | 160/84.1 |
| 5,135,461 | 8/1992 | Corey et al. | 493/7 |
| 5,141,041 | 8/1992 | Katz et al. | 160/84.1 |
| 5,156,196 | 10/1992 | Corey et al. | 160/178.2 |
| 5,160,563 | 11/1992 | Kutchmarek et al. | 156/204 |
| 5,193,601 | 3/1993 | Corey et al. | 160/84.1 |
| 5,207,257 | 5/1993 | Rupel et al. | 160/84.1 |
| 5,341,864 | 8/1994 | Rupel et al. | 160/84.1 |

CELLULAR SHADE MATERIAL

This application is a continuation of application Ser. No. 08/208,981 filed 10, Mar. 1994, now abandoned.

BACKGROUND OF THE INVENTION

The present invention is directed to closures for apertures in which the closure has a first position in which the closure may be fully extended to cover the aperture, a second position in which the closure may be fully retracted to uncover the aperture to the fullest extent, and intermediate positions between the first position and second position in which the closure partially covers the aperture. More particularly, the invention is directed to retractable closures for windows, where the closure may be positioned to block off all or a portion of the window. The invention is still further directed to such retractable closures, wherein a series of individual cells, each of which enclose a discrete longitudinal space, are disposed across the span of the closure to form a decorative window shade which may be actuated between open, intermediate and closed positions.

For many decades, retractable window coverings have been employed to close off the view through a window. A "venetian" blind is one such common window coveting. During the energy crisis of the 1970's, window coverings were introduced wherein the slats of the "venetian" blind were replaced by individual air trapping pleats, or cells. These cells are formed by configuring the fabric which comprises the body of the window covering into groups of longitudinal extending tubular pleats, which extend either the width, or height, of the window to be covered. In a top retracting shade, the cells constitute a series of horizontal tubes stacked and interconnected one atop the other. In a side retracting shade, the cells constitute a series of vertical tubes interconnected along their sides. In a top pulling shade, the lowest tube in the series is received in lower rail assembly, and the lower rail assembly is interconnected, by the extending cells and at least two pullcords, to an upper rail assembly at the top of the shade. The upper rail and lower rail assemblies typically include an outer channel into which an inner rail is received. The last cell in the shade is pinched between the channel and inner rail, to secure the cell to the rail assembly. A slat may extend through the cell within the rail assembly and double-sided tape may be used between the cell and inner rail to further secure the cell in the rail assembly. Pullcords are attached to the lower rail assembly and pass upwardly through the cells and into the upper rail assembly, with a portion of the cords extending through the upper rail assembly and hanging down along the side of the shade. The ends of the pullcords are joined, and may be attached to a single lift cord. When the lift cord is pulled, the lower rail assembly attached to the cords actuates upward, causing the individual cells adjacent thereto to collapse into flat sections as the lower rail assembly moves upwardly to open the shade. In the partially open position, those cells adjacent the lower rail assembly are collapsed while those extending downward from the top of the shade remain open. Thus, as the lower rail assembly moves upwardly, the cell next adjacent to the lower rail assembly and stack of collapsed cells thereon collapses. When the shade is fully retracted, all of the cells are collapsed to provide a structure having a lower rail assembly, a stack of collapsed cells thereon, and an upper rail assembly disposed at the top of the opening. To extend the shade, the lift cord is manipulated to allow the lower rail assembly to fall or actuate away from the upper rail assembly, which carries the stack of collapsed cells downward thereon. The uppermost cell will first open as the lower rail assembly moves from the upper rail. As the lower rail assembly continues to fall, consecutive cells open from the top of the stack of folded cells. If the movement of the rail assembly is stopped to partially obstruct the view through the window, the shade will have a series of open cells extending from the upper rail assembly to a stack of collapsed cells stacked on the lower rail assembly.

It is contemplated that this structure may be reversed, and the cords rerouted, such that in the retracted position the stack of collapsed cells, and the upper rail assembly thereon, are located at the base of the window, and when the free end of the cord is pulled, the upper rail assembly extends the cells attached thereto into an open position as it moves upwardly. This configuration is particularly useful on first floor windows, where the lower part of the window may be blocked for privacy, and the upper half of the window exposed to allow sunlight to enter through the window or opening. Additionally, side opening shades may be constructed, and in such shades the upper and lower rail assemblies and cell assembly are turned to a vertical position, and the window is exposed, or blocked, by actuating the "lower" rail assembly transversely across the window or opening.

The individual cells of the shade are typically manufactured by interconnecting discrete folded strips of shade fabric to form air-enclosing cells. Each folded strip may substantially form the boundary of an individual cell, or opposite sides of folded strips may be staggered to form different portions of adjacent cells. For example, U.S. Pat. No. 4,450,027, *Colson*, FIG. 14, discloses a cell structure in which the majority of the cell is defined by one folded strip of fabric. A small gap appears between the edges 44, 43, of the folded fabric strip, and this gap is bridged by the fabric of the next adjacent cell. As for staggered fabric-to-cell construction, U.S. Pat. No. 4,631,217, *Anderson*, discloses a structure in which each fabric strip comprises approximately one-half of each of two adjacent cells.

SUMMARY OF THE INVENTION

A pleated shade material is provided for use in a shade to adjustably cover all or part of a window opening. The shade material includes a plurality of pleat cells having opposed cell walls. Each pleat cell is assembled from one length of shade material which is folded over to form upper and lower cell walls, and the walls are interconnected adjacent their free edges to form the cell. To form the shade one cell wall of one cell is affixed to the opposite cell wall of the next adjacent cell. The size and aesthetic presentation of the cell may be varied by varying the distance from the free edges of the cell walls at which the cell walls of each individual cell are connected.

BRIEF DESCRIPTION OF THE DRAWINGS

These, and other advantages and embodiments of the invention will become apparent from reading the accompanying description, with reference to the accompanying drawings, wherein.

BRIEF DESCRIPTION OF THE PREFERRED EMBODIMENT

Figure 1:
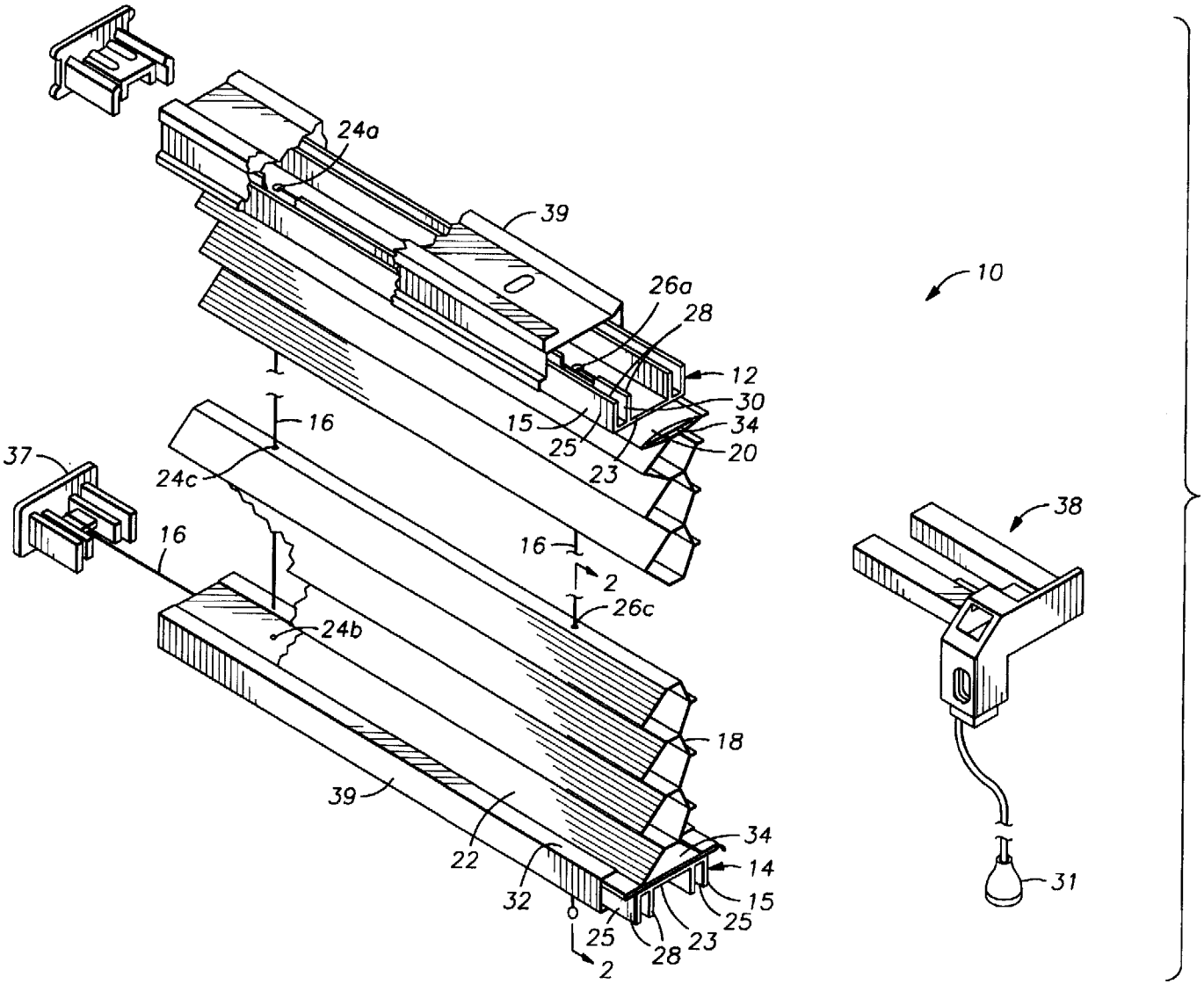
FIG. 1 is an exploded view of the pleated shade material of the present invention assembled into a shade assembly.

Referring to FIG. 1, a pleated shade assembly 10 for use with the shade material of the present invention includes an upper rail assembly 12, a lower rail assembly 14, cords 16 and a plurality of interconnected pleat cells 18. The uppermost cell 20 of the plurality of cells 18 is connected to the upper rail assembly 12, and the lowermost cell 22 of cells 18 is connected to lower rail assembly 14, and thus cells 18 interconnect upper rail assembly 12 and lower rail assembly 14.

Upper rail assembly 12 and lower rail assembly 14 each include a rail portion 15, which includes a generally flat cell attachment portion 23 having opposed extending finger portions 25 extending therefrom substantially perpendicular thereto. Finger portions 25 include two parallel extending walls 28, forming space 30 therebetween. Uppermost cell 20 of the plurality of cells 18 is attached to cell attachment portion 23 of rail portion 15 of upper rail assembly 12, and lowermost cell 22 of the plurality of cells 18 is attached to cell attachment portion 23 of rail portion 15 of lower rail assembly 14.

Upper and lower rail assemblies 12, 14 further include a locking channel 39, which is configured to receive inner rails 15. Each locking channel 39 includes an opposed overriding lip portion 32 which is received over cell attachment portion 23 on inner rail 15 (best shown in FIG. 2). To help secure upper cell 20 on upper inner rail 15, and lower cell 22 on lower inner rail 15, a thin metal slat 34 is placed through cells 20, 22, and the cells 20, 22 and inner rails 15 are slipped into the end of upper and lower rail assemblies 12, 14. Overriding lip portions 32 of channel 39 press the outer surface of each of cells 20, 22 and slat 34 therein against inner rail 15. Because slat 34 extends under lip portions 32, the flexible fabric which forms the walls of uppermost and lowermost cells 20, 22 is prevented from pulling out from under lip portions 32 by the edges of slat 34. Double-sided tape or other fastening means may be provided between inner rail 15 and the fabric of respective cell 20, 22 to limit movement of the cell with respect to inner rail 15.

To actuate lower rail assembly 14 upwardly to open shade assembly 10, holes 24*a*, 26*a*are provided in upper inner rail 15, holes 24*b*, 26*b* are provided in lower inner rail 15 (26*b* shown in FIG. 2), and holes 24*c*, 26*c* are provided through cells 18. Holes 24, *a,b,c* are aligned, as are holes 26*a, b, c*. Cords 16 are secured through each series of holes 24 *a, b, c* and 26*a, b, c*, and are connected to one of two end caps 37 (only one shown) provided in the end of lower inner rail 15 of lower rail assembly 14. The cords 16 are passed through upper inner rail 15, and are received through a ratchet 38 disposed into one end of upper rail assembly 12 and partially received in the spaces 30 in the end of inner rail 15. Ratchet 38 selectively secures cords 16 therein to hold shade assembly 10 open when desired.

Figure 2:
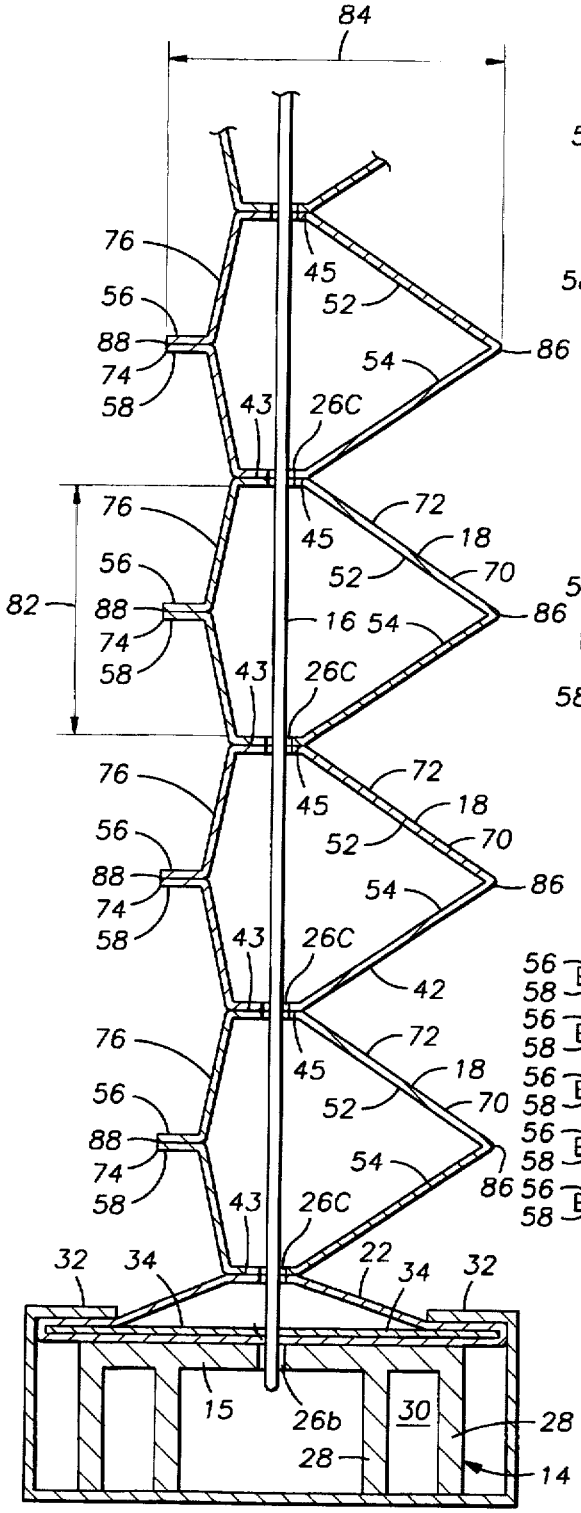
FIG. 2 is a sectional view of the shade assembly of FIG. 1 at section 2—2.
Figure 3:
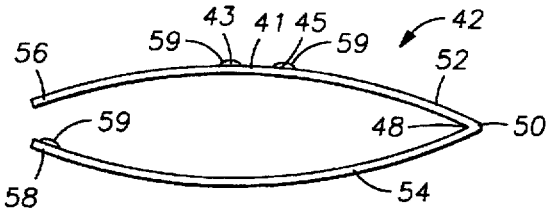
FIG. 3 is an end view of the shade fabric of the present invention prior to assembly into a cell.
Figure 4:
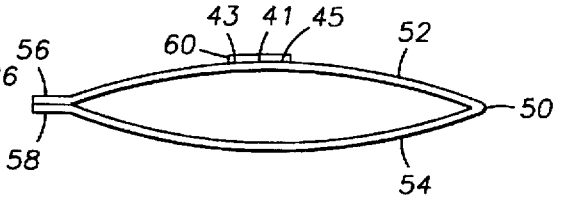
FIG. 4 is an end view of a single cell prior to assembly into a shade.
Figure 5:
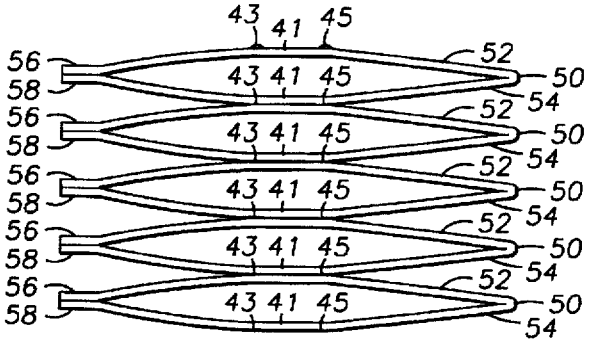
FIG. 5 is an end view of a plurality of interconnected cells.

Referring now to FIGS. 2 through 5, the structure of the individual cells is shown. As shown in FIG. 3, each of cells 18 is comprised of a length of shade material 42 having opposed edges 56, 58, and a longitudinal center line 50 disposed therebetween. To create the configuration shown in FIG. 3, a length of shade material 42 is folded longitudinally about longitudinal center line 50. This folding creates a crease 48 formed along the approximate longitudinal center line 50 of the length of shade material, creating upper and lower cell walls 52, 54 extending between the opposed edges 56, 58 and the crease 48 of shade material 42. The span of shade material 42 between crease 48 and edge 56 forms the upper cell wall 52, and the span between crease 48 and edge 58 forms the lower cell wall 54. To create a shade, edges 56, 58 are interconnected as shown in FIG. 4, and a portion of the upper cell wall 52 of one cell 18 is interconnected to the lower cell wall 54 of the adjacent cell 18 along two zones 43, 45 disposed adjacent either side of the center 41 of upper cell wall 52 as shown in FIG. 5. Zones 43, 45 extend the length of each cell 18. This attachment is repeated, until sufficient cells 18 are interconnected to form the desired overall shade height. The interconnection of adjacent cell walls 52, 54 of adjacent cells 18 may be accomplished by placing glue beads 59 (FIG. 3) longitudinally along the length of each upper cell wall 52 along the zones 43, 45 to interconnect the walls 52, 54 along each zone 43, 45, or alternatively, locating an adhesive strip 60 (FIG. 4) spanning the adjacent zones 43, 45 on upper cell wall 52, and adhering lower cell wall 54 of the next adjacent cell 18 thereto. The attachment of edges 56, 58 may be accomplished with a glue bead 59, sonic sealing, or other means. Shade material 42 is preferably Hydroentangled Polyester, Spun-Bond Polyester or Thermobond Polyester, and glue bead 59 may be a high temperature, hot-melt thermoplastic polyester UV-stabilized material such as Tivolmelt 195-A, available from Ward Adhesives of Waukesha, Wis., or a non-crystallizing version thereof, although it is contemplated that other materials may be used without deviating from the scope of the invention.

To create the individual cells 18 of FIGS. 3 or 4, a continuous length of shade material, preferably several hundred feet long, is folded to form crease 48, and the folded or creased length of shade material receives the glue beads 59, tape 60 or other adhesives thereon for interconnecting the edges 56, 58 of each cell 18 and for connecting adjacent cells 18 at zones 43, 45. The continuous length of creased fabric is preferably rolled onto a core, and then later unrolled and cut into lengths corresponding to the proper shade span. Once the lengths of folded shade material are cut to the length for specific enclosure span, they are stacked together with the edges 56, 58 vertically aligned, and the individual cells 18 of edges 56, 58, and the upper and lower cell 52, 54 walls of pleats 18, are adjacent. Where glue beads 59 are used to connect adjacent surfaces, the stack of cells 18 are placed under heat and pressure. Where zones 43, 45 are interconnected with tape, and edges 56, 58 are connected with glue 59, both heat and pressure are used. Where the edges 56, 58 are sonically sealed, the edges 56, 58 are first connected by the sonic sealing, and then the cells 18 are connected together along the zones 43, 45 by heat and/or pressure as required.

Referring now to FIG. 2, a plurality of fully extended cells 18 are shown connected to a fully extended lower rail assembly 14. The individual cells 18 include projecting angled faces 70 on the front side 72 thereof forming a tip 86 at their furthermost forward extension, and a fin 74 on the rear side 76 thereof. Fin 74 is formed from the attached portion of edges 56, 58. The mass of shade material on the rear side of zone 43 is approximately equal to the mass of shade material on the front side of zone 45. As zones 43, 45 are spaced substantially equidistant from the center 41 of cell wall 52, and they are located on the lower cell wall 54 approximately equidistant to center 41 thereof, the mass on either side of the center line 41 of each cell wall 52, 54 is approximately equal. Each cell has a cell height 82, extending from the full extension of upper cell wall 52 to the full extension of lower cell wall 54 of the cell 18, and a cell width 84 extending from the front tip 86 of angled face 70 to the end 88 of fin 74. The ratio of cell height 82 to cell width 84 may be adjusted by varying the size of fin 74 or by changing the span between the adjacent attachment zones 43, 45, without significantly changing the center of mass of the cell 18.

Figure 6:
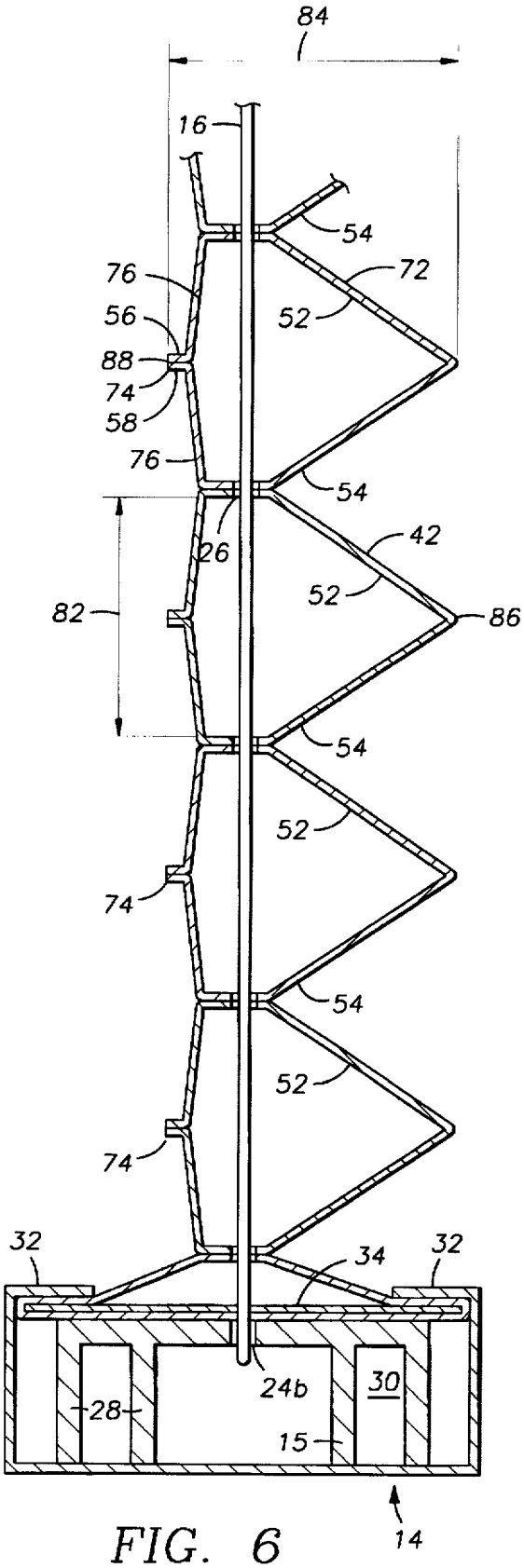
FIG. 6 is an alternative configuration of a plurality of cells of the pleated shade of the present invention.
Figure 7:
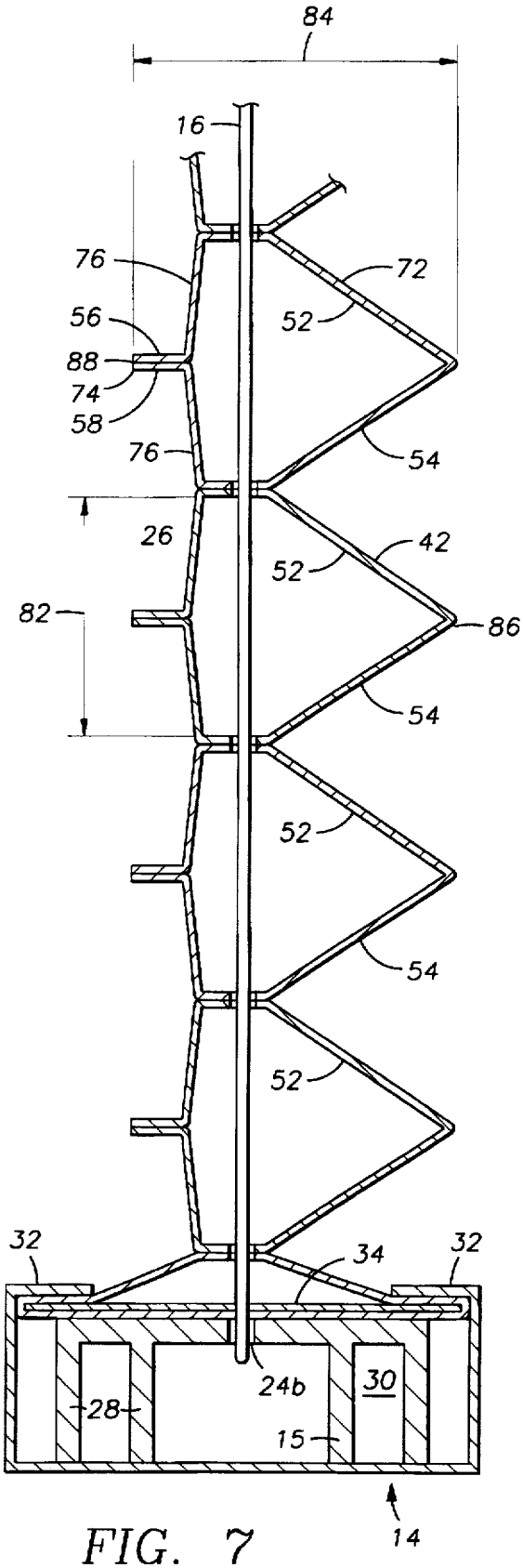
FIG. 7 is an additional alternative configuration of a plurality of cells of the pleated shade of the present invention.

Referring now to FIGS. 6 and 7, alternative presentations of the shade material are shown. In the shade profile shown in FIG. 6, the location of the attached portion of upper cell wall 52 and lower cell wall 54 is placed closely along edges 56, 58 such that the width of fin 74 is reduced. This reduced width fin 74 allows the cell height 82 between the full extension of the upper cell wall 52 and lower cell wall 54 of each cell 18 relative to the width 84 of the cell 18 to increase. As the spacing of zones 43, 45 is not changed from that of the cells 18 in FIG. 2, the increase in cell height 82 causes a decrease in cell width 84.

Referring to FIG. 7, the fin 74 is extended from that shown in FIG. 2 or 6. This is accomplished by extending the width of the interconnection of upper cell wall 52 and lower cell wall 54 at edges 56, 58 to form an elongated fin 74. The upper and lower cell walls 52, 54 of the individual cells 18 are preferably adhered together over the entire width of the fin 74 with glue, or other sealing mechanisms. Care must be taken to leave a slight gap between the adhesive and the edge of fin 74, so that the adhesive does not ooze out as the adhesive is set. As the fin 74 is extended by moving the attachment location away from the edges 56, 58 of upper and lower cell walls 52, 54, and the spacing between zones 43, 45 is not changed from that shown in FIG. 2, the cell width 84 is increased in relation to cell height 82.

The width and height of the cells 18 may also be changed by varying the distance between zones 43, 45, and by varying the width of fin 74 in conjunction with that change. It has been found that the size of fin 74 may be varied without significantly changing the aesthetic presentation of the front side 72 of the shade normally seen by the consumer. Thus, numerous shades may be made having matching front side 72 presentation for a single installation, while cell width 84 and cell height 82 may be optimized for each shade.

Although the present invention has been described in terms of a horizontal shade with hidden pullcords, the configuration of the pull cords, and parts thereof, may be varied without deviating from the scope of the invention. Likewise, the cell 18 of the present invention is well suited to side pull, i.e., vertical shades, and bottom retracting shades.

We claim:

1. A cellular pleated shade member having a plurality of interconnected cells, at least one of the cells comprising:

a strip of shade material folded lengthwise to form an upper cell wall and a lower cell wall extending from a fold, each upper and lower cell wall having a free edge and a folded edge;

said upper cell wall and lower cell wall of said strip interconnected adjacent their respective free edges; and said upper cell wall and said lower cell wall each having at least one attachment zone on each side of a longitudinal center line of each said cell wall for connecting said cell to an adjacent cell.

2. The cellular pleated shade of claim 1, wherein one of said upper cell wall and lower cell wall includes two attachment zones that extend longitudinally thereon.

3. The cellular pleated shade of claim 1, wherein said free edges of said upper cell wall and lower cell wall are interconnected by sonic welding.

4. The cellular pleated shade of claim 1, wherein said free edges of said upper cell wall and lower cell wall are interconnected by an adhesive glue.

5. The cellular pleated shade of claim 1, wherein said free edges of said upper cell wall and lower cell wall are interconnected by an adhesive strip.

6. The cellular pleated shade of claim 2, further including a pullcord disposed through the pleats of said cellular pleated shade between said two attachment zones.

7. The cellular pleated shade of claim 1, wherein said cell is connected to said adjacent cell at said attachment zones.

8. The cellular pleated shade of claim 7, wherein a glue bead connects said cell to said adjacent cell at each said attachment zone.

9. The cellular pleated shade of claim 7, wherein an adhesive strip connects said cell to said adjacent cell at each said attachment zone.

10. A cellular shade for covering a window, said shade comprising:

a plurality of longitudinally extending, substantially parallel interconnected fabric cells, wherein substantially all cells within said plurality of cells have for each cell:

a front side and a rear side;

a crease forming a tip on said front side;

an upper cell wall extending from said crease and having a rear edge, said upper cell wall having a longitudinal center line equidistant along said upper cell wall from said crease and from said rear edge of said upper cell wall;

a lower cell wall extending from said crease and having a rear edge, said lower cell wall and said upper cell wall being substantially equal in length; and a fin on said rear side, wherein said fin is formed by joining a portion of said upper cell wall adjacent said rear edge of said upper cell wall with a portion of said lower cell wall adjacent said rear edge of said lower cell wall; and material located on at least one of said upper cell wall and said lower cell wall for attaching each cell of said plurality of cells to an adjacent cell of said plurality of cells.

11. The cellular shade of claim 10, wherein said material for attaching includes an adhesive strip.

12. The cellular shade of claim 11, wherein said adhesive strip passes through said longitudinal center line of said upper cell wall.

13. The cellular shade of claim 10, wherein said material for attaching includes at least one glue bead.

14. The cellular shade of claim 13, wherein said at least one glue bead passes through said longitudinal center line of said upper cell wall.

15. The cellular shade of claim 10, wherein said material for attaching includes a glue bead on each side of said longitudinal center line of said upper cell wall.

16. The cellular shade of claim 15, wherein said glue beads are approximately equidistant along said upper cell wall from said longitudinal center line of said upper cell wall.

17. The cellular shade of claim 10, wherein said portion of said upper cell wall adjacent said rear edge of said upper cell wall is joined with said portion of said lower cell wall adjacent said rear edge of said lower cell wall by a glue bead.

18. The cellular shade of claim 10, wherein said portion of said upper cell wall adjacent said rear edge of said upper cell wall is joined with said portion of said lower cell wall adjacent said rear edge of said lower cell wall by an adhesive strip.

19. The cellular shade of claim 10, wherein said portion of said upper cell wall adjacent said rear edge of said upper cell wall is joined with said portion of said lower cell wall adjacent said rear edge of said lower cell wall by sonic welding.

20. The cellular shade of claim 10, wherein when said cellular shade is extended, the interior surfaces of said upper cell wall and said lower cell wall define a six-sided polygon, said six-sided polygon having an upper rear side, an upper middle side, an upper front side, a lower front side, a lower middle side, and a lower rear side.

21. The cellular shade of claim 20, wherein said fin, said upper middle side and said lower middle side are substantially in parallel arrangement.

22. The cellular shade of claim 20, wherein an interior angle defined by said upper from side and said lower front side is less than an interior angle defined by said upper rear side and said lower rear side.

23. The cellular shade of claim 20, wherein said upper middle side is approximately equal in length to said lower middle side.

24. A cellular shade for covering a window, said shade comprising:

a plurality of longitudinally extending interconnected fabric cells, wherein each cell within said plurality of cells has:

a front side and a rear side;

a crease forming a tip on said front side;

an upper cell wall extending from said tip and having a rear edge, said upper cell wall having an upper surface and an interior surface and having a longitudinal center line equidistant along said upper cell wall from said tip and from said rear edge of said upper cell wall;

a lower cell wall extending from said tip and having a rear edge, said lower cell wall having a lower surface and an interior surface, said lower cell wall and said upper cell wall being substantially equal in length; and a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall;

an adhesive on substantially all cells of said plurality of cells, said adhesive for connecting each cell of said substantially all cells to an adjacent cell of said plurality of cells;

an upper rail assembly, said upper rail assembly attached to an uppermost cell of said plurality of cells;

a lower rail assembly, said lower rail assembly attached to a lowermost cell of said plurality of cells; and a pullcord, said pullcord for raising and lowering one of said upper and lower rail assembly in relation to the other of said upper and lower rail assembly.

25. The cellular shade of claim 24, wherein said adhesive includes an adhesive strip on said upper surface of said upper wall.

26. The cellular shade claim 25, wherein said adhesive strip passes through said longitudinal center line of said upper cell wall.

27. The cellular shade of claim 24, wherein said adhesive includes an adhesive strip on said lower surface of said lower cell wall.

28. The cellular shade of claim 24, wherein said adhesive includes a glue bead on said upper surface of said upper cell wall.

29. The cellular shade of claim 28, wherein said glue bead passes through said longitudinal center line of said upper cell wall.

30. The cellular shade of claim 24, wherein said adhesive includes a first glue bead on said upper surface of said upper cell wall and a second glue bead on said upper surface of said upper cell wall, said first and said second glue beads being on opposite sides of said longitudinal center line of said upper cell wall.

31. The cellular shade of claim 30, wherein said first and said second glue beads extend longitudinally along said upper surface of said upper cell wall of said cell.

32. The cellular shade of claim 31, wherein said first portion of said interior surface of said upper cell wall adjacent said rear edge of said upper cell wall is joined with said first portion of said interior surface of said lower cell wall adjacent said rear edge of said lower cell wall by an adhesive.

33. The cellular shade of claim 32, wherein when said cellular shade is extended, a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side.

34. The cellular shade of claim 33, wherein said fin, said upper middle side and said lower middle side are substantially in parallel arrangement.

35. The cellular shade of claim 33, wherein an interior angle defined by said upper front side and said lower front side is less than an interior angle defined by said upper rear side and said lower rear side.

36. The cellular shade of claim 35, wherein said first and said second glue beads are approximately equidistant along said upper cell wall from said longitudinal center line of said upper cell wall.

37. The cellular shade of claim 36, wherein said first glue bead is proximate to a front end of said upper middle side and said second glue bead is proximate to a rear end of said upper middle side.

38. The cellular shade of claim 37, wherein said upper middle side is approximately equal in length to said lower middle side.

39. The cellular shade of claim 24, wherein said adhesive includes a first glue bead on said lower surface of said lower cell wall and a second glue bead on said lower surface of said lower cell wall.

40. The cellular shade of claim 39, wherein when said cellular shade is extended, a second portion of said interior surface of said upper cell wail and a second portion of said interior surface of said lower cell wall define a six-sided polygon, said six-sided polygon having an upper rear side, an upper middle side, an upper front side, a lower front side, a lower middle side, and a lower rear side.

41. The cellular shade of claim 40, wherein said fin, said upper middle side and said lower middle side are substantially in parallel arrangement.

42. The cellular shade of claim 40, wherein an interior angle defined by said upper front side and said lower front side is less than an interior angle defined by said upper rear side and said lower rear side.

43. The cellular shade of claim 40, wherein said upper middle side is approximately equal in length to said lower middle side.

44. The cellular shade of claim 43, wherein said first glue bead is proximate to a front end of said lower middle side and said second glue beads is proximate to a rear end of said lower middle side.

45. The cellular shade of claim 44, wherein said first and said second glue beads extend longitudinally along said lower surface of said lower cell wall of said cell.

46. The cellular shade of claim 45 wherein said first portion of said interior surface of said upper cell wall adjacent said rear edge of said upper cell wall is joined with said first portion of said interior surface of said lower cell wall adjacent said rear edge of said lower cell wall by an adhesive.

47. A cellular shade for covering a window, said shade comprising:

a plurality of longitudinally extending interconnected fabric cells, wherein substantially all cells within said plurality of cells have for each cell:

a front side and a rear side;

a crease forming a tip on said front side;

an upper cell wall extending from said tip and having a rear edge, said upper cell wall having an upper surface and an interior surface and having a longitudinal center line equidistant along said upper cell wall from said tip and from said rear edge of said upper cell wall;

a lower cell wall extending from said tip and having a rear edge, said lower cell wall having a lower surface and an interior surface; and a fin on said rear side, wherein said fin is formed by joining a first portion of said interior surface of said upper cell wall adjacent said rear edge of said upper cell wall with a first portion of said interior surface of said lower cell wall adjacent said rear edge of said lower cell wall;

an adhesive on substantially all cells of said plurality of cells, said adhesive for connecting each cell of said substantially all cells to an adjacent cell of said plurality of cells, wherein said adhesive includes a first glue bead on said upper surface of said upper cell wall and a second glue bead on said upper surface of said upper cell wall, said first and said second glue beads being on opposite sides of said longitudinal center line of said upper cell wall, said first and said second glue beads extending longitudinally along said upper surface of said upper cell wall;

an upper rail assembly, said upper rail assembly attached to an uppermost cell of said plurality of cells;

a lower rail assembly, said lower rail assembly attached to a lowermost cell of said plurality of cells; and a pullcord, said pullcord for raising and lowering said one of said upper and lower rail assembly in relation to the other of said upper and lower rail assembly;

wherein when said cellular shade is extended, a second portion of said interior surface of said upper cell wall and a second portion of said interior surface of said lower cell wall define a six-sided polygon, said six-sided polygon having an upper rear side, an upper middle side, an upper front side, a lower front side, a lower middle side, and a lower rear side;

the length of said upper middle side and said lower middle side are of approximately equal lengths, the length of said upper middle side being less than the length of either of said upper rear side and said upper front side, and the length of said lower middle side being less than the length of either of said lower rear side and said lower front side; and said fin, said upper middle side and said lower middle side are in substantially parallel arrangement.

* * * * *

Adverse Decision In Interference

Patent No. 5,692,550, James A. Ford, Don L. Bertva, James M. Kennedy, Ronald L. Presdorf, CELLULAR SHADE MATERIAL, Interference No. 104,329, final judgment adverse to the patentees rendered September 30, 2004, as to claims 1-47.

*(Official Gazette February 22, 2005)*